United States Patent [19]

Tank et al.

[11] Patent Number: 4,586,554

[45] Date of Patent: May 6, 1986

[54] PROCESS FOR MANUFACTURING FIBER REINFORCED LIGHT METAL CASTINGS

[75] Inventors: Eggert Tank, Wernau; Peter Straub, Fellbach, both of Fed. Rep. of Germany

[73] Assignee: Daimler-Benz Aktiengesellschaft, Fed. Rep. of Germany

[21] Appl. No.: 698,795

[22] Filed: Feb. 6, 1985

[30] Foreign Application Priority Data

Feb. 7, 1984 [DE] Fed. Rep. of Germany ..... 3404092

[51] Int. Cl.[4] ..... B22D 19/14

[52] U.S. Cl. ..... 164/97; 164/120

[58] Field of Search ..... 164/97, 120

[56] References Cited

U.S. PATENT DOCUMENTS 3,853,635 12/1974 Demendi ..... 164/97 X 4,492,265 1/1985 Donomoto et al. ..... 164/97 X

*Primary Examiner*—Kuang Y. Lin

*Attorney, Agent, or Firm*—Barnes & Thornburg

[57] ABSTRACT

A process is provided for the production of fibre-reinforced light-metal castings by die casting. A fibre moulding is introduced into an auxiliary mould and the auxiliary mould is heated to an optimum temperature above the melting point of the light metal. The auxiliary mould is then inserted with positive fit into a die casting mould corresponding to the outer contour of the auxiliary mould and filled with light metal under pressure. The fibre moulding can optionally be stabilized by means of a temporary organic binder which decomposes when the auxiliary mould is heated.

11 Claims, No Drawings

PROCESS FOR MANUFACTURING FIBER REINFORCED LIGHT METAL CASTINGS

BACKGROUND AND SUMMARY OF THE INVENTION

One of the most important processes for the production of fibre-reinforced light metal castings is die casting. However, it is found that, in the mass production of such fibre-reinforced castings, difficulties can arise which manifest themselves in the appearance of cavities and/or other irregularities in the casting. Moreover, it is relatively difficult to consistently introduce the reinforcing fibres into the die casting mould in the correct quantity and orientation due to the short cycle time of modern die casting machines. For example, in German Patent Specification No. 2,701,421, a relatively expensive process was described in which a small fibre-reinforced casting is produced in a first step, and light metal is then cast around it in another mould in order to produce the final casting.

It is therefore one object of the present invention to provide a process for the production of fibre-reinforced light metal castings by die casting, which enables fault-free castings to be produced in a relatively simple manner even in mass production.

Further objects, features, and advantages of the present invention will become more apparent from the following description.

According to the invention, fibrous material is introduced into an auxiliary mould. Depending on the casting to be produced, the auxiliary mould has two or more parts and is provided with orifices for the entry of molten metal and with outlet orifices for air in a manner known in the art. A plurality of small orifices is preferred in order to avoid displacement of the fibrous material due to high flow velocities during casting or when the mould is to be evacuated. The auxiliary mould can have relatively thin walls since it is to be supported later in the process by a die casting mould in a die casting machine.

The fibrous material, which serves to reinforce the casting, is introduced into this auxiliary mould as a finished premoulding or as portions of a fibre moulding or as a random fibre structure within the auxiliary mould. The fibrous material is formed to give a finished fibre moulding.

By using a temporary organic binder, the forming of the fibre moulding can be substantially facilitated. It is particularly advantageous that this binder be degradable upon heating of the auxiliary mould, thereby eliminating the need for separate process step for binder degradation. The binder may comprise, for example, polymethyl methacrylate, alginates or derivatives thereof.

The fibres constituting the fibre moulding may, for example, consist of glass, carbon, metals and oxides such as $Al_2O_3$ and ceramic material. They can be present either in the form of short fibres, fiberous particles or as continuous filaments.

After the fibre moulding has been introduced into the auxiliary mould, the auxiliary mould is closed. During this step, a voluminous, light, fibre moulding of low apparent density and low fibre content per unit volume can advantageously be compacted in such a way that the desired fibre density in the casting is reached.

The closed auxiliary mould filled with the fibre moulding is then transferred into a preheating oven which operates batchwise or continuously. Within the oven, the auxiliary mould is preferably heated to a temperature between the melting point of the particular metal to be cast into the mould and about 850° C. Heating to temperatures between 650° and 750° C. is especially preferred. The heating can be performed under a blanketing gas if required.

The heating may be continued until the temporary binder has been completely decomposed if a binder is employed.

After the desired temperature has been reached and the temporary binder which may be present has been decomposed, the auxiliary mould is introduced at this temperature, with positive fit, into a die casting mould corresponding to the outer contour of the auxiliary mould. The auxiliary mould is filled under pressure immediately afterward with a desired light metal such as aluminium, magnesium or alloys containing these metals. After solidification of the metal, the auxiliary mould is removed from the die casting mould and opened. The finished fibre-reinforced light metal casting is then removed from the auxiliary mould.

Fibre meshes, or fabrics or strands, and particularly those in a compacted state, resist penetration of molten metal, and accordingly the liquid metal must be pressurized in order to overcome this resistance. The pressure under which the liquid metal is forced into the mould can vary from on the order of a few bars if the wetting angle between metal and fibre is small, the packing of the fibres is loose and the penetration rate of the metal is low, to up to 3000 bars if conditions are adverse. If the fibre packing contains a gas which must be displaced by the melt, additional pressure must be applied for this displacement. If the auxiliary mould is to be evacuated before casting, the clamping joints may advantageously be sealed, for example with a heat-resistant graphite foil.

It may also be desirable to seal the melt entry points and gas exit orifices of the auxiliary mould in order to ensure that no molten metal can pass in an undesirable manner into any spaces present between the auxiliary mould and the die casting mould.

Due to the preheating of the auxiliary mould, the fibre moulding will have the optimum temperature during casting so that fault-free casting can take place. Closing of the die casting mould should take place very quickly after insertion of the auxiliary mould, and cooling of the auxiliary mould due through radiation should be kept within limits. Of course, after the die casting mould has been closed, cooling of the auxiliary mould through heat absorption into the metal masses of the die casting mould begins. This absorption is due to the close physical contact of the auxiliary mould with the substantially colder die casting mould, but this cooling does not take place suddenly because of the mass of the auxiliary mould. Since the cycle times of the die casting machine are equal, the heat outflow before the metal is poured in can be compensated for by a corresponding increase in the temperature of the auxiliary mould. In this manner, precisely the desired temperature prevails in the fibre moulding at the time of casting. Moreover, by appropriate design of the die casting mould in a manner known in the prior art, such as with quench plates, the heat outflow through the wall of the auxiliary mould can be regulated in the intended manner and controlled solidification of the melt can be achieved. If the heat outflow is regulated in such a way that the solidification of the metal starts at the end opposite the in-gate, the pressure in the mould can be maintained from the in-gate until the metal in the auxiliary mould has completely solidified. In this manner, casting faults, such as, for example, shrink holes, are completely avoided. In addition, greater strength of the light metal cast piece produced is obtained. A major advantage of the process according to the present invention is that, due to optimum temperature control of the auxiliary mould, fibre-reinforced light metal castings can be produced without faults even in long production runs. The process is particularly advantageous when used in the manufacture of fibre-reinforced components for motor vehicles, such as pistons and gudgeon pins, valve spring caps, rocker arms, bucket tappets, cylinders, connecting rods, parts of the wheel suspension, stub axles, suspension arms and axles.

Although the present invention has been described in detail, it is to be clearly understood that the same is by way of illustration and example only, and is not to be taken by way of limitation. The spirit and scope of the present invention are to be limited only by the terms of the appended claims.

We claim:

1. A die casting process for the production of fibre reinforced metal castings containing fibrous material and metal comprising:

placing said fibrous material into an opened reusable auxiliary mould means, said mould means having at least two parts, closing said auxiliary mould means, heating said auxiliary mould means containing said fibrous material to a temperature at which said metal exists in a molten state, placing said auxiliary mould means into a die casting mould means with positive fit, said die casting mould means having an inner contour corresponding to an outer contour of said auxiliary mould means, and filling said auxiliary mould means with said metal in a molten state under pressure.

2. A process according to claim 1, wherein said pressure is maintained until said metal in a molten state has solidified.

3. A process according to claim 2, wherein said fibrous material is in a compressed state when said auxiliary mould means is closed.

4. A process according to claim 1, wherein said fibrous material contains a binder means.

5. A process according to claim 4, wherein said binder means comprises an organic binder.

6. A process accordihg to claim 5, wherein said organic binder is selected from a group consisting of alginates and methacrylate polymers.

7. A process according to claim 1, wherein said fibrous material is composed of a material selected from the group consisting of glass, carbon, metals and metal oxides.

8. A process according to claim 1, wherein said auxiliary mould means is heated to a temperature between the melting point of said metal and about 850° C.

9. A process according to claim 1, wherein said auxiliary mould is heated to a temperature between about 650° C. and 750° C.

10. A process according to claim 5, wherein said binder is degraded when said auxiliary mould means is heated.

11. A process according to claim 1, wherein said fibre-reinforced metal casting is a component for a motor vehicle.

* * * * *